US007008085B1

(12) United States Patent
Czlonka

(10) Patent No.: US 7,008,085 B1
(45) Date of Patent: Mar. 7, 2006

(54) SUSPENDED LIGHT FIXTURE SERVICING SYSTEM

(76) Inventor: Tony Czlonka, 10933 Claude Lewis Rd., Middlesex, NC (US) 27557

( * ) Notice: Subject to any disclaimer, the term of this patent is extended or adjusted under 35 U.S.C. 154(b) by 0 days.

(21) Appl. No.: 10/711,105

(22) Filed: Aug. 24, 2004

(51) Int. Cl.
*F21V 21/16* (2006.01)

(52) U.S. Cl. ..... 362/407; 362/404; 362/408

(58) Field of Classification Search ..... 362/404, 362/405, 406, 407, 408, 387, 391, 147
See application file for complete search history.

(56) References Cited

U.S. PATENT DOCUMENTS 1,375,224 A * 4/1921 Maclewee ..... 362/407
1,666,411 A * 4/1928 Olier, Jr. ..... 439/529
1,702,502 A * 2/1929 Olier, Jr. ..... 59/78.1
5,317,493 A * 5/1994 Muller et al. ..... 362/407
2003/0193810 A1 * 10/2003 Patz et al. ..... 362/387

* cited by examiner

*Primary Examiner*—Thomas M. Sember
(74) *Attorney, Agent, or Firm*—Mills Law Firm PLLC

(57) ABSTRACT

A light servicing system for suspended lighting that may be lowered from operating height to a testing and servicing height while remaining connected to the fixture electrical service includes a mate and lock connector providing plug in connection to the fixture electrical service thereby avoiding the need to disconnect the wiring. The fixture chain is provided with a releasable link to permit removal of the fixture without special tools. A tethering assembly having an adjustable fixed length includes upper and lower hooks for engaging the chain and fixture across the releasable link. Upon release of the link, the tethering assembly allows manual lowering of the fixture to a suspended testing height to avoid damage to fixture components. Prior to lowering, an extended umbilical power cord is spliced at the mate and lock connector to provide circuit power to the lighting unit for validating the operations of the fixture prior to remounting.

8 Claims, 3 Drawing Sheets

SUSPENDED LIGHT FIXTURE SERVICING SYSTEM

FIELD OF THE INVENTION

The present invention relates to suspended lighting apparatus and, in particular, to a system for the installation, repair, maintenance and replacement of suspended light fixtures.

BACKGROUND OF THE INVENTION

Typical light fixtures may include a plurality of bulbs and decorative appendages that require replacement, cleaning and maintenance from time to time. Generally such procedures require the maintenance person, such as a homeowner, to climb a ladder to access the fixture and conduct the replacement of bulbs, and clean and repair the fixture components at a precarious elevated position. Should the person desire to change fixtures or change elevation thereof, the power cord must be removed at the outlet box, one of the chain links opened, and the fixture manually disengaged and lowered. For larger chandelier type units multiple personnel are required. Such lowering generally places the fixture on the floor or support table. Many fixtures, however, include fragile assemblies or pendant pieces that can be damaged or dislodged in such positions. After removal and repair, the operability of the fixture and the individual bulbs can only be determined and rectified in the raised position, inasmuch as ground testing of the fixture is not possible. If unsatisfactory, the procedure must be repeated, each time removing and reattaching the electrical leads.

Various approaches have been disclosed for simplifying the electrical connection of the light fixture.

U.S. Pat. No. 1,666,223 to Symmes discloses a suspended light fixture having a plug in connection to the electrical outlet. No provisions are made for assisting lowering and testing of the unit. Similar light fixture connections are disclosed in U.S. Pat. No. 6,062,712 to Hsich and U.S. Pat. No. 4,378,584 to Russello.

Lowering devices for lighting units have been provided for facilitating bulb replacement in exterior and non-residential applications. U.S. Pat. No. 5,393,245 to Hinds provides a portable lowering tool for high elevation light fixtures, such as church lighting. Therein an extendable tool carrying a payout line is coupled to a pulley wheel at the lighting fixture and is operative to lower the fixture to servicing height. Electrical service is disconnected upon lowering. U.S. Pat. No. 6,142,824 to Savoca discloses a crank based system for raising and lowering utility lights wherein the fixture is disengaged from electrical service upon lowering.

None of the foregoing fulfills the deficiencies noted above, and it would be desirable to provide lighting installation compatible with residential needs that would permit the safe lowering of suspended lighting to a servicing height without the need for specialized or expensive tools, and would permit the full testing and confirmation of operability prior to reinstallation.

BRIEF SUMMARY OF THE INVENTION

The present invention provides a light maintenance system for original or existing lighting that may be lowered from operating height with simple components to a testing and servicing height while remaining connected to the fixture electrical service for actual circuit validating testing.

The light maintenance system includes a mate and lock connector providing plug in connection to the fixture electrical service thereby avoiding the need to disconnect the wiring. The fixture chain is provided with a releasable link to permit removal of the fixture without special tools. A tethering assembly having an adjustable fixed length includes upper and lower hooks for engaging the chain and fixture across the releasable link. Upon release of the link, the tethering assembly allows manual lowering of the fixture to a testing height, preferably in suspended condition, to avoid damage to fixture components. Prior to lowering, an extended umbilical power cord is spliced at the mate and lock connector to provide circuit power to the lighting unit for validating the operations of the fixture prior to raising by reverse procedures.

Accordingly, it is an object of the invention to provide a convenient system for servicing suspended lighting.

Another object of the invention is to provide a servicing system that may be used for new and existing suspended light fixtures.

A further object of the invention is to provide for the safe lowering of a suspended light fixture to a servicing height while maintaining operative electrical connections.

DESCRIPTION OF THE DRAWINGS

The above and other features of the present invention will become apparent upon reading the following description of the preferred embodiments taken in conjunction with the accompanying drawings in which.

DETAILED DESCRIPTION OF THE PREFERRED EMBODIMENTS

Figure 1:
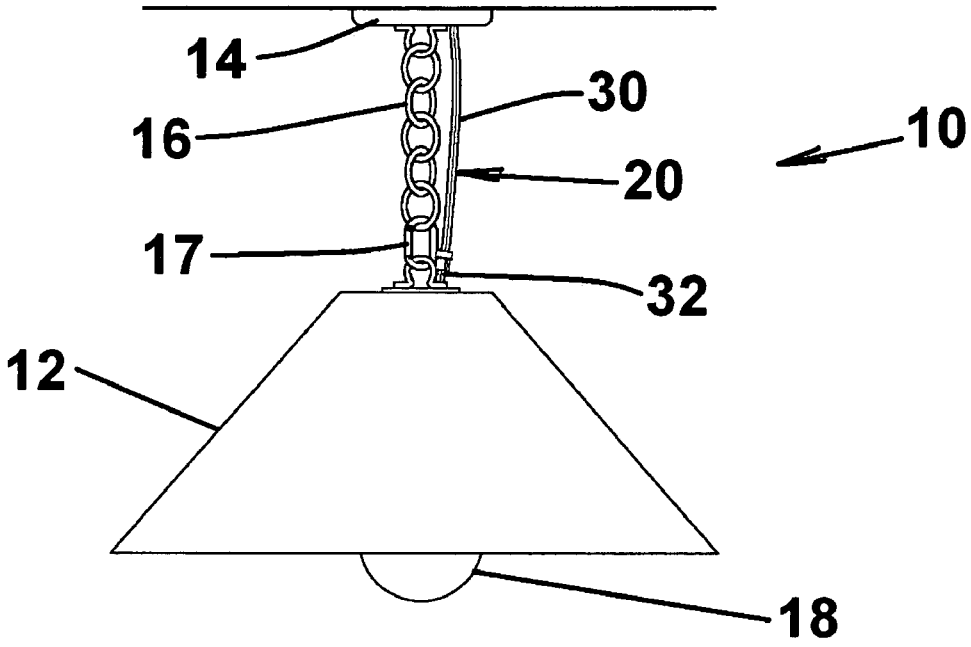
FIG. 1 is a front elevational view of suspended light assembly according to the invention in the operative raised position.

Referring to FIG. 1 for the purpose of describing a preferred embodiment of the invention and not for limiting same, there is shown a suspended or pendant light assembly 10 having a light fixture 12 suspended from a ceiling mount assembly 14 by a linked chain 16 including a lower releasable link 17. The light unit 18 of the fixture 12 is electrically connected by a main power cord assembly 20 to the electrical service at an electrical receptacle, not shown, above the mount assembly 14.

Figure 2:
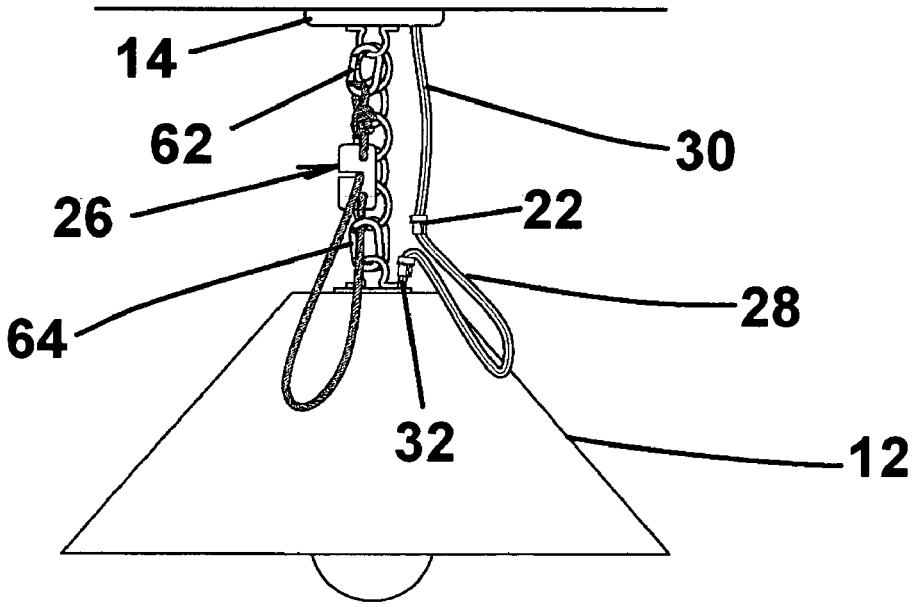
FIG. 2 is a front elevational view of a suspended light assembly in a normal raised position having the light servicing system attached thereto.
Figure 3:
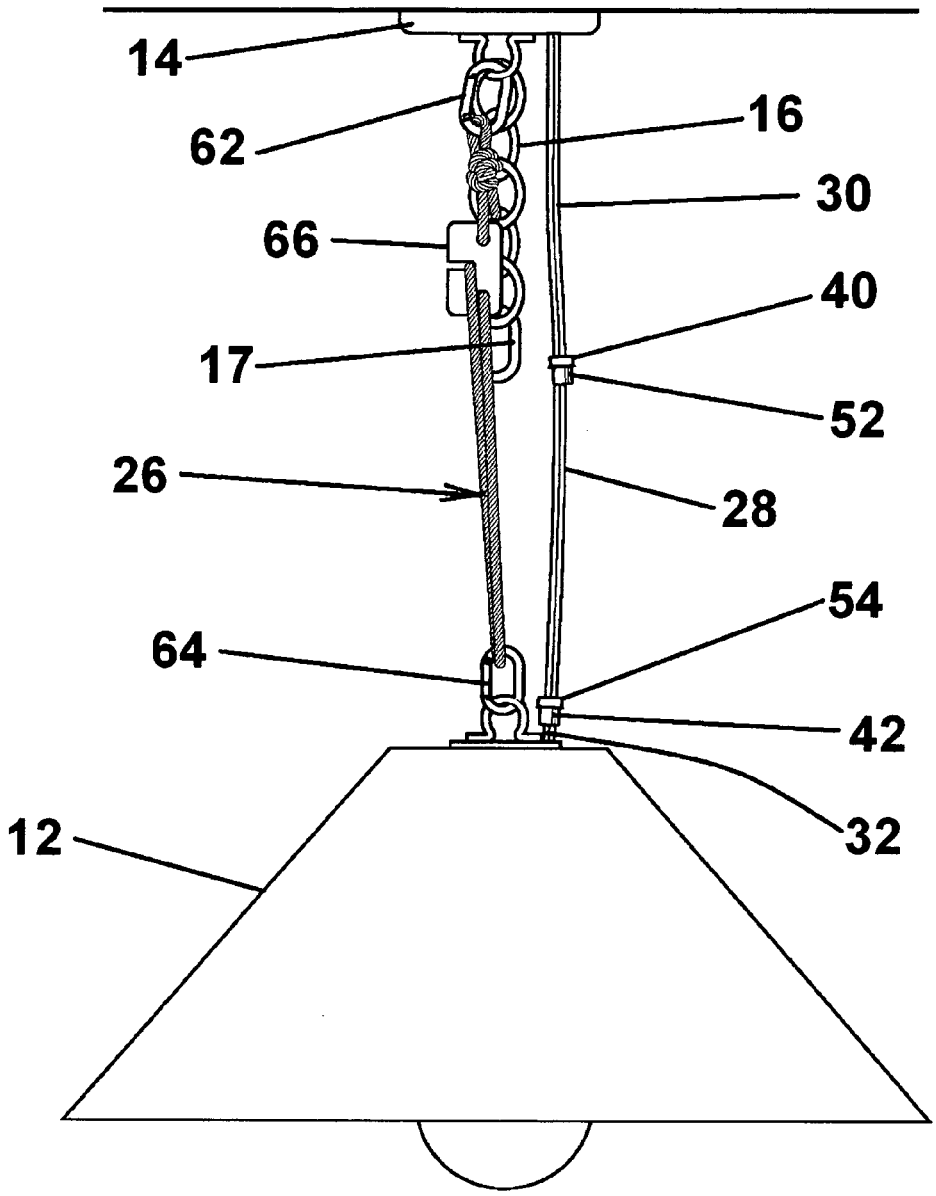
FIG. 3 is a front elevational view of the suspended light assembly in a lowered servicing position with the umbilical electrical cord maintaining power to the light.

The servicing of the fixture 12 is facilitated by a light servicing system including a mate and lock connector 22 in the main power cord assembly 20 that permits electrical connection and disconnection without wire operations at the receptacle. Referring to FIGS. 2 and 3, servicing is further facilitated a tether assembly 26 that permits the lowering of the light fixture 12 to a servicing height, and an umbilical electrical cord 28 that permits testing of the light fixture 12 at the servicing height through the actual fixture circuit. The system may be employed in connection with original installation components or available as a kit for retrofitting existing light fixtures. The main power cord assembly 20 includes an upper cord assembly 30 and a lower cord assembly 32 connected at the mating and locking main connector 22.

The releasable link 17 preferably is a spring arm construction, commonly referred to as a "caribeener". Therein, the link 17 includes a side arm 34 pivots inwardly to allow detachment from an adjacent link. Accordingly, the link 17 may be optionally removed from a higher or lower link in the chain 16. The link 17 is preferably finished compatible with the other chain links. Alternatively, an existing link in the chain may be conventionally separated to allow separation of the fixture 12 from the chain 16.

Figure 4:
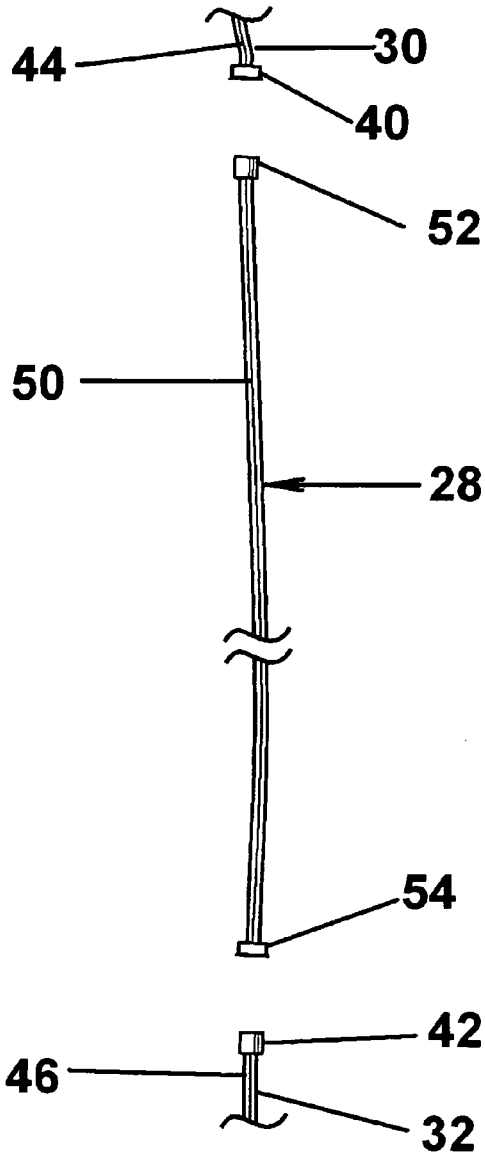
FIG. 4 is a plan view of the umbilical cord.

Referring to FIG. 4, the main connector 22 comprises a cap or socket 40 that telescopically mates with a plug 42. The cap 30 carries plural socket contacts connected to the leads of the upper pigtail or power cord 44 of the upper power cord assembly 30. The upper ends of the upper power cord 44 are stripped for conventional connection with the overhead electrical service. The plug 42 carries plural internal pin contacts connected to the leads of the lower of the lower pigtail or power cord 46 of the lower cord assembly 32. The lower ends of the lower power cord 46 are stripped for conventional connection with the fixture terminals. The socket 40 and plug 42 are configured for telescopic keyed one-way mating and detenting at a locked condition completing the electrical circuit therebetween. Suitable connectors are commercially available in the Mate-N-Lock series soft-shell connectors from Norton On Line. A preferable inline cap housing is type 1-480305-0 and recommended pin terminals, and a plug housing is type 1-480303-0 and recommended socket terminals.

Referring to FIG. 4, the umbilical cord 28 electrically interconnects the upper power cord assembly 30 and the lower cord assembly 32 in movement to the lowered test and servicing position. The umbilical cord 28 comprises a center power cord 50 having a plug 52 identical to the plug 42 at the upper end for mating and locking contact with the socket 40 and a socket 42 identical to the socket 40 at the lower end for mating and locking contact with the plug 42.

Figure 5:
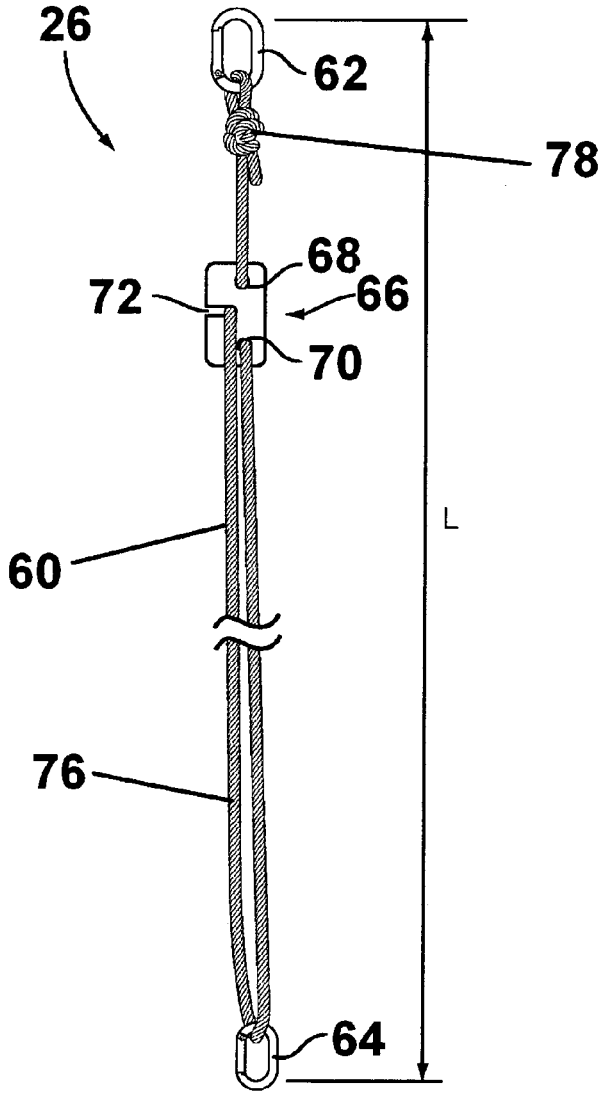
FIG. 5 is a plan view of the tethering cord assembly.

The tether assembly 26 is manually operable for lowering the light fixture 12 from the raised operative position and maintaining the light fixture at a predetermined lower position for maintenance, repair, and/or replacement. Referring to FIG. 5, the tether assembly 26 comprises a cord 60, an upper release hook 62, a lower release hook 64 and a cord slide 66. The cord slide 66 is generally rectangular having holes 68, 70 at opposed ends and a transverse locking slot 72 at the center. The release hooks 62, 64 are preferably the caribeener type links described above that allow for easy and secure installation at the associated link. The lower end 74 of the cord 60 is inserted through the lower hole 70 and knotted, and the free end 76 of the cord 60 is serially downward inserted through the lower release hook 64, extended upwardly through the upper hole 68 and knotted at 78 to the upper release hook 62. In use, the slide 66 is moved along the free end 76 to establish a desired supporting length "L" between the engagement surfaces of the hooks 62, 64 and the cord 60 inserted into the slot 72 to lock the slide and cord against relative movement.

For maintenance, repair and/or replacement, the operator establishes a length L for the tether assembly 26 that will establish a convenient appropriate lowered position of the light fixture for conducting the desired operations thereon. Thereafter, the main connector 22 is disassembled, and the umbilical cord assembly 28 connected to the socket 40 of the upper power cord assembly 30 and the plug 42 of the lower cord assembly 32. The lighting service may be actuated to confirm operability of the connection. Next the operator grips the tether assembly 26 and slightly raises the fixture 12, releases the link 17, and lowers the fixture 12 until the weight is borne by the tether assembly 26 at the lowered tethered position. Depending on the fixture and working preferences, the lowered position may be a lowered suspended height, a supported elevated position such as a table, or direct location on the floor. Inasmuch as many light fixtures are elaborate with pendants that may be dislodged or damaged at surface engagement, a tether position at convenient working height is preferred. Thereat, the fixture may be cleaned, polished and repaired, non-operating bulbs replaced and the operability determined by restoring electrical service. If a replacement fixture is desired for installation, the lower release hook 64 of the tether assembly 26 is released from the fixture 12 and refastened to the replacement light fixture.

After completion of the operations, the fixture 12 is raised with the tether assembly 26 for reattachment by the release link 17, and the linkage reestablished. The release hooks 62, 64 are removed to release the tether assembly 26, the umbilical cord assembly 28 removed, and the main connector 22 reassembled.

It will be apparent that alternative tethering devices may be employed for controlling the raising and lowering of the fixture. Pulleys with cord locking devices can be incorporated to facilitate movement. Further, the free end of the cord may be looped through the upper release hook, rather than knotted, and an adjustable stop member carried on the cord would engage the upper release hook to establish the tethered, elevated test position.

The system thus as a kit or integrated feature allows the convenient raising of light fixtures for installation and lowering for maintenance operations.

Having thus described a presently preferred embodiment of the present invention, it will now be appreciated that the objects of the invention have been fully achieved, and it will be understood by those skilled in the art that many changes in construction and widely differing embodiments and applications of the invention will suggest themselves without departing from the sprit and scope of the present invention. The disclosures and description herein are intended to be illustrative and are not in any sense limiting of the invention, which is defined solely in accordance with the following claims.

What is claimed is:

1. A servicing system for a suspended lighting assembly including a light fixture attached by chain links to a mount assembly on a ceiling and including a first power cord for connecting light means on the fixture to an electrical source at the ceiling, said system facilitating the servicing the light fixture at a lowered suspended height, said system comprising: a connector member in said first power cord including a socket member and a plug member operatively coupled in an mounted condition and uncoupled at a service condition; a elongated second power cord operatively coupled with said plug member and said socket member of said connector member in said service condition; a releasable link in said chain links, said releasable link being engaged between adjacent links in said mounted condition, and disengaged from said adjacent links in said service condition; an adjustable length tether assembly having a first end connected in said service condition to said chain links above said releasable link, and a second end operatively connected in said service condition to said light fixture and supporting said light fixture in said service position at a suspended height for maintenance and repair thereof.

2. The light servicing system as recited in claim 1 wherein said releasable link includes a spring biased arm for facilitating engagement and disengagement with an adjacent link.

3. The light servicing system as recited in claim 2 wherein said first end is a first releasable link assembly.

4. The light servicing system as recited in claim 3 wherein said second end is a second releasable link assembly.

5. The light servicing system as recited in claim 4 wherein said plug member and said socket member have a telescopic one way engagement.

6. The light servicing system as recited in claim 4 wherein second power cord has a socket member for connection with said plug member of said first power cord and a plug member for connection with said socket member of said first power cord.

7. The light servicing system as recited in claim 6 wherein said tethering assembly includes a cord member between said first end and said second end including a slide member for adjustably varying the effective length between said ends and accordingly the suspended height of said light fixture.

8. The light servicing system as recited in claim 7 wherein said cord member has one end connected to said slide member and another end connected one of said releasable link assemblies and slidably received through said other releasable link assembly and locking means between said cord member and said slide member for fixing said effective length.

* * * * *